United States Patent [19]

Tomaszewski

[11] 4,404,074

[45] Sep. 13, 1983

[54] ELECTROLYTIC STRIPPING BATH AND PROCESS

[75] Inventor: Lillie C. Tomaszewski, Dearborn, Mich.

[73] Assignee: Occidental Chemical Corporation, Warren, Mich.

[21] Appl. No.: 382,522

[22] Filed: May 27, 1982

[51] Int. Cl.[3] ..... C25F 5/00

[52] U.S. Cl. ..... 204/146; 204/129.95

[58] Field of Search ..... 204/146, 129.95

[56] References Cited

U.S. PATENT DOCUMENTS 4,233,124 11/1980 Tomaszewski ..... 204/146

4,264,420 4/1981 Tomaszewski ..... 204/146

*Primary Examiner*—T. M. Tufariello

*Attorney, Agent, or Firm*—Richard P. Mueller

[57] ABSTRACT

An improved electrolytic bath composition and process for stripping relatively thick copper, copper alloy, or chromium deposits from a ferrous basis metal comprising an aqueous solution having a pH of from about 1 to about 14 and consisting essentially of an amine, nitro, and/or nitrate stripping component; and sodium glucoheptonate present in an effective amount to inhibit attack of the basis metal. The solution may further include at least one bath soluble compound selected from the group consisting of malic acid, oxalic acid, and mixtures thereof, as well as the Group IA, IIA, and ammonium salts thereof, present in an effective amount, when combined with said sodium glucoheptonate, to inhibit attack of the basis metal; and/or a carboxylic acid buffering agent comprising at least one material selected from the group consisting of gluconic acid, lactic acid, tartaric acid, fumaric acid, citric acid, isoascorbic acid, succinic acid, acetic acid, and mixtures thereof, as well as the alkali metal and ammonium salts thereof. The stripping of the metal deposit is effected by immersion of the object in the bath while anodically charged and passing electric current through the bath to a cathode for a period of time sufficient to achieve the desired magnitude of stripping of the metal deposit.

30 Claims, No Drawings

ELECTROLYTIC STRIPPING BATH AND PROCESS

BACKGROUND OF THE INVENTION

The present invention is broadly applicable to a solution and method for electrolytically stripping or removing unwanted metallic deposits or platings from substrates, and more particularly, for stripping unwanted metal plating deposits such as copper, copper alloys, or chromium from electroplating apparatus such as the contact tips of stainless steel work racks, as well as for removing defective or damaged metallic platings from ferrous substrates such as steel in order to enable the stripped articles to be replated without incurring any etching or damage to the steel substrate.

In the art of electroplating, it is conventional practice to support work pieces to be plated on a work rack which is comprised of a chemically resistant metal such as platinumized titanium or stainless steel or a conventional steel work rack having a protective coating thereover such as a polyvinyl chloride plastisol coating. The electrification of the work pieces while suspended in a suitable electrolyte is achieved by stainless steel or platinumized titanium contact tips on the rack which are connected in electrical contact with the work pieces. During an electroplating operation, an unwanted metal deposit builds up on the contact tips of the work rack which interferes with the efficiency and consistency of the electroplating operation. It is common practice, accordingly, to subject such work racks to mechanical or chemical cleaning treatments in order to periodically remove the unwanted metal deposit accumulation in order to maintain optimum operating efficiency thereof.

The stripping or removal of certain metal deposits is also occasionally required from articles which have been electroplated but wherein the resultant electrodeposit or electroless metal deposit is defective or has become mechanically damaged during handling in order to salvage the article and enable a reprocessing thereof. The stripping or removal of the metal deposit from the surfaces of such articles must be performed in a manner which does not materially etch or damage the underlying substrate to a degree which prevents replating thereof and without requiring substantial polishing and/or buffing operations to restore the substrate surface to a condition in which it can be replated.

In the case of stripping metal deposits from electroplating apparatus such as the contact tips of work racks, it is important that the stripping solution and conditions employed do not materially effect an attack of the contact tips themselves causing a progressive errosion of such contact tips thereby reducing the efficiency of the electroplating operation and necessitating frequent reworking and replacement of such contact tips.

A variety of chemical and electrolytic stripping processes and solutions have heretofore been used or proposed for use for removing unwanted metal deposits of various types from substrates including plated articles as well as contact tips of electroplating apparatuses. Typical of such prior art practices and compositions are those disclosed in U.S. Pat. Nos. 2,057,272; 2,578,898; 2,581,490; 2,588,566; 2,596,307; 3,151,049; 3,257,299; 3,492,210; 3,617,456; 3,619,390; 3,649,489; 3,793,172; 3,912,603; 4,048,006; 4,052,254; 4,233,124; 4,244,833; and 4,264,420, to which reference is made for the further details of the processes and the teachings of which are incorporated by reference. A continuing problem associated with many prior art electrolytic stripping formulations and processes has been their inability to effectively strip a wide variety of different metal deposits necessitating separate solutions and processes for the several types of metal deposits to be removed, the relatively slow stripping rate of certain prior art techniques in removing unwanted metal deposits, and the tendency of certain prior art stripping formulations and processes to attack and damage the basis metal during the course of the stripping of the metal deposit therefrom. The present invention may be considered an improvement over U.S. Pat. Nos. 4,233,124 and 4,264,420 as far as the removal of copper, copper alloy, or chromium deposits from ferrous substrates is concerned. As noted above, the teachings of these two patents are incorporated by reference herein. With regard to these last two mentioned patents, it has been found that the elimination of the halogen component, as used in the compositions of these two patents, provides a bath and process capable of stripping relatively thick copper deposits or the like without any build-up of halides on the surface being stripped during the stripping operation. Such a halide build-up in some instances fouls and insulates the surface being stripped, especially in the case of relatively thick metal deposits, i.e., greater than about 1 mil (one thousandth of an inch) up to several inches in thickness. The elimination of the halogen component, however, would not be preferred for stripping metals such as nickel.

The present invention provides for an electrolytic stripping bath and process which is adaptable and particularly suited for rapidly and efficiently stripping relatively thick copper, copper alloy, or chromium deposits from a ferrous basis metal, and which is inhibited so as to significantly reduce the attack and etching of the basis metal during the stripping operation.

SUMMARY OF THE INVENTION

The benefits and advantages of the present invention are achieved, in accordance with the composition aspects thereof, by a stripping bath comprising an aqueous solution having a pH of from about 1 to about 14 and consisting essentially of an amine, nitro, and/or nitrate stripping component and sodium glucoheptonate present in an effective amount to inhibit attack of the basis metal. The solution may further include at least one bath soluble compound selected from the group consisting of malic acid, oxalic acid, and mixtures thereof, as well as the Group IA, IIA, and ammonium salts thereof, present in an effective amount, when combined with said sodium glucoheptonate, to inhibit attack of the basis metal; and/or a carboxylic acid buffering agent comprising at least one material selected from the group consisting of gluconic acid, lactic acid, tartaric acid, fumaric acid, citric acid, isoascorbic acid, succinic acid, acetic acid, and mixtures thereof, as well as the alkali metal and ammonium salts thereof. The sodium glucoheptonate may be present in an amount of from about 1 g/L to saturation, with from about 5 to about 50 g/L being preferred. The above-defined bath soluble compound may generally be present in an amount of from about 1 to about 20 g/L, although in some instances higher concentrations may be used. When malic acid is used along with sodium glucoheptonate in a preferred form of the present invention, both are preferrably used in concentrations of about 10 g/L each. The inclusion of a controlled effective amount of sodium glucoheptonate, either alone or with other inhibiting agents such as the above-defined bath soluble compounds (malic acid and/or oxalic acid, and the like), significantly reduces the corrosion or etching of the basis metal during the stripping process. The carboxylic acid buffering agent may be present in an amount of up to about 60 g/L, with from about 20 to about 40 g/L being preferred. The aqueous solutions of the present invention are substantially free of halogen or halide compounds, and thus would not contain these materials in amounts in which they would function as active ingredients.

In the amine-type stripping bath, a controlled effective amount usually ranging from about 15 to about 200 g/L of a primary, secondary, and/or tertiary alkyl or alkanol amine containing from $C_1$ to $C_8$ carbons is employed in combination with nitric acid as necessary to provide the requisite pH of the stripping bath. In the so-called amine-free type stripping formulation, aqueous soluble organic nitro and/or inorganic nitrates are employed in lieu of the amine, and pH adjustment of the operating bath can be effected by nitric acid, acetic acid, or the like, as well as alkali metal hydroxides including ammonium hydroxide. As will be referred to in further detail hereinbelow, concentrations of the nitrate and/or nitro compound may range from about 10 to about 480 g/L, calculated as ammonium nitrate or equivalent, with from about 50 to about 240 g/L being typical. It is also contemplated that mixed baths containing both the amine and the organic nitro and/or inorganic nitrate stripping components can be employed.

In accordance with the process aspects of the present invention, the stripping of unwanted metal deposits such as copper, copper alloys such as brass and bronze, as well as chromium, is effected by immersing an object with the metal deposit thereon in the aqueous stripping solution with the object anodically charged, and passing electric current through the bath between a cathode and the object for a period of time sufficient to effect the desired magnitude of stripping of the metal deposit. The aqueous stripping solution can be operated at room temperature (60° F.) up to about 150° F. with temperatures of about 70° to about 100° F. being preferred for stripping deposits from a mild steel basis metal, and from about 120° to about 140° F. being preferred for stainless steels, such as the contact tips of work racks. Lower temperatures, such as about 100° F., may be used on other stainless steel substrates such as stainless steel parts. The current density during the stripping operation will vary depending upon the resistivity of the basis metal to attack by the stripping solution. In connection with electroplating apparatus such as the contact tips of work racks, for example, which are comprised of a resistant stainless steel alloy such as a type 304 stainless steel or better, current densities of from about 50 to about 1500 amperes per square foot (ASF) can be employed, whereas for stripping metal deposits from conventional steel substrates, lower current densities of about 25 to about 200 ASF can satisfactorily be employed.

Additional benefits and advantages of the present invention will become apparent upon a reading of the description of the preferred embodiments taken in conjunction with the specific examples provided hereinbelow.

DESCRIPTION OF THE PREFERRED EMBODIMENTS

The stripping bath of the present invention is primarily adapted but not necessarily limited to the stripping of copper, copper alloy, or chromium deposits from ferrous parts comprised of a relatively non-resistant basis metal such as mild or high carbon steel. With regard to plating racks, the present invention is primarily adapted but not necessarily limited to the stripping of copper, copper alloy, or chromium deposits from ferrous racks comprised of stainless steel such as types 301, 304, or 316.

The unexpected effect of the stripping bath and process of the present invention has been observed and demonstrated in both so-called amine type as well as so-called amine-free type stripping baths. Both of these type electrolytic stripping baths comprise aqueous solutions which contain hydrogen ions and which can operate at a pH range of about 1 up to about 14, and preferably at a pH of about 5.0 to about 7.5. Of course, the particular pH used depends to some extent upon the particular bath components utilized. Generally, the lower the pH, the more rapid is the stripping of the metal deposit. A pH as low as about 1 is commercially impractical because of the difficulty in maintaining such a low pH during bath operation. On the other hand, a pH as high as about 14 is also commercially impractical because of the unacceptably low stripping rate. From a preferred commercial standpoint, the stripping bath may be maintained at an operating pH of from about 5.5 to about 7.0 when stripping metal deposits from objects composed of a relatively non-resistant ferrous basis metal such as steel, for example. When stripping metal deposits from articles composed of a relatively resistant basis metal, such as stainless steel, for example, a pH range of about 5.5 to about 7.0 is preferred from a commercial standpoint.

In the amine-type stripping bath, the stripping formulation contains as a stripping component, an effective amount of an aqueous soluble primary, secondary, and/or tertiary amine or mixtures thereof having a carbon content ranging from about $C_1$ up to about $C_8$, depending on whether the amine is of the primary, secondary, or tertiary type. The concentration of the amine in the bath is controlled within conventional prior art practices and typically can range from about 15 to about 200 g/L with the specific concentration established by the type of metal deposit being stripped to attain optimum stripping action. Alkanol amines are particularly preferred because of their solubility in the bath. Typical of the amines that can be satisfactorily employed are ethylene diamine, triethanolamine, isopropanolamine, monoethanolamine, butylamine, hexylamine, diamylamine, diethanolamine, dimethanolamine, triethylamine, tripropylamine, and the like. It will be appreciated that the amine-type stripping bath may also contain variable amounts of organic nitro and/or inorganic nitrate compounds of the same types employed in amine-free baths. When using such a mixture of stripping components, the concentration of the amine stripping component can be correspondingly decreased in consideration of the quantity of the nitrate/nitro compound present to maintain the desired stripping action. The amine-type stripping bath further contains nitric acid used as necessary to adjust the pH of the electrolytic stripping bath within a range of about 1 to about 14. The presence of the amine in the bath normally provides a pH of about 9 to about 10, and during operation sufficient nitric acid is incorporated to reduce the pH to within the aforementioned range and preferably within a range of about 5.0 to about 7.5 in consideration of any carboxylic acid buffering agent which may also be present, as will be referred to further hereinbelow.

The amine-free stripping bath contains a controlled effective amount of bath soluble organic nitro and/or organic nitrate compounds sufficient to attain the desired stripping action. The specific concentration employed will vary depending upon the type of metal deposit to be stripped as well as the resistance of the basis metal to chemical attack. Inorganic nitrate compounds which can satisfactorily be employed comprise the alkali metal and/or ammonium nitrate compounds along with nitric acid itself to adjust the bath as necessary within the required pH range. Typical of aqueous soluble organic nitro compounds that can be satisfactorily employed are nitrobenzoic acid, 4-nitroisophthalic acid, sodium nitrobenzoate, sodium meta-nitrobenzene sulfonate, and the like. For the electrolytic stripping of metal deposits from relatively resistant basis metals, such as for example, type 304 or type 316 stainless steels, the concentration of the nitrate and/or nitro compound can usually range from about 10 up to about 250 g/L calculated as ammonium nitrate or equivalent, with concentrations of about 30 to about 50 g/L being preferred. In electrolytic stripping baths employed for stripping metal deposits such as copper from conventional steel basis metals, the concentration of the nitrate and/or nitro compound can broadly range from about 50 g/L to about 480 g/L calculated as ammonium nitrate.

In addition to the foregoing constituents, the amine and amine-free electrolytic stripping baths contain as an essential constituent, sodium glucoheptonate, which functions as an inhibitor agent for inhibiting attack of the basis metal during the electrostripping process. Sodium glucoheptonate should be present in an effective amount to inhibit attack of the basis metal. As noted above, sodium glucoheptonate may be present in an amount of as low as about 1 g/L up to saturation in the stripping bath. Preferably, the sodium glucoheptonate is employed in amounts of about 5 to about 50 g/L. Amounts above about 50 g/L normally do not provide any appreciable benefits over that achieved employing concentrations of about 50 g/L.

As an optional but preferred component, the solution used with the stripping bath and process of the present invention may further include at least one bath soluble compound selected from the group consisting of malic acid, oxalic acid, and mixtures thereof, as well as the Group IA, IIA, and ammonium salts thereof. This component should be present in an effective amount, when combined with the above-referenced sodium glucoheptonate, to inhibit attack of the basis metal. This component in effect acts as a secondary inhibiting agent since it is used in addition to sodium glucoheptonate, which may be considered the primary inhibiting agent of the present solution. The above-referenced bath soluble compounds may generally be pesent in an amount of from about 1 to about 20 g/L, although in some instances higher concentrations may be used. In a preferred form of the present invention, about 10 g/L of malic acid may be combined with about 10 g/L of sodium glucoheptonate to give a total concentration of these inhibitor-type materials of about 20 g/L. In general, the combined concentrations of sodium glucoheptonate and the bath soluble compounds referred to above may range from about 1 g/L to saturation, with from about 5 to about 75 g/L being preferred. With regard to oxalic acid, ammonium oxalate is a preferred form for use with the present invention.

As yet another optional but preferred component which may be used either with the above-referenced bath soluble compounds or by itself, the solution used with the stripping bath and process of the present invention may further include a carboxylic acid buffering agent. Such a buffering agent may comprise at least one material selected from the group consisting of gluconic acid, lactic acid, tartaric acid, fumaric acid, citric acid, isoascorbic acid, succinic acid, acetic acid, and mixtures thereof, as well as the alkali metal and ammonium salts thereof. These buffering agents may be present in an amount of up to about 60 g/L, with from about 20 to about 40 g/L being preferred. In addition to functioning as a buffering agent in the conventional chemical sense, some of these materials may also function somewhat as sequestering or chelating agents to help hold metals at preferred concentrations. For example, sodium citrate is usable in such a dual role.

It is to be noted, however, that although the amounts of the various components set forth above are typical of the amounts which may be used, this is not to say that amounts of these components which are outside of these ranges may not be used. Rather, it is intended that although for many typical operations of the process of the present invention these amounts have been found to be preferred, in many instances, amounts which are both greater than and less than those which have been specifically recited will also produce satisfactory results. In this regard, it is to be appreciated that the specific amount of each of these additive components which is used will, of course, depend upon the particular amounts of the other components which are utilized.

In accordance with the process aspects of the present invention, the amine and amine-free electrolytic stripping bath can be satisfactorily operated at a temperature of about room temperature (60° F.) up to about 150° F. Agitation, such as by air or mechanical means, is usually preferred. when stripping metal deposits from relatively resistant basis metals, such as a type 301 stainless steel alloy, for example, current densities of from about 50 up to about 1500 ASF can be employed at voltages generally ranging from about 3 up to about 15 volts. Preferably, when stripping the contact tips of work racks for example, comprised of at least a type 304 stainless steel, current densities of about 500 ASF at a voltage of about 4 is preferred. Lower current densities, such as about 90 ASF, may be used on other stainless steel substrates such as stainless steel parts. On the other hand, when stripping defective metal deposits from relatively low resistant substrates such as conventional steel, for example, current densities of about 25 up to about 200 ASF can be employed at voltages usually ranging from about 3 up to about 10 volts. The stripping process is accomplished by immersing the object to be stripped in the electrolytic stripping solution and connecting the object to the anode and passing current through the stripping bath between the object and cathode at the desired current density for a period of time sufficient to effect the desired magnitude of stripping of the metal deposit.

In order to further illustrate the composition and process of the present invention, the following examples are provided. It will be understood that the examples are provided for illustrative purposes and are not intended to be limiting of the scope of the present invention as herein described and as set forth in the subjoined claims.

EXAMPLE 1

An electrolytic stripping bath suitable for stripping relatively thick copper deposits from mild steel is formulated containing 240 g/L ammonium nitrate, 10 g/L sodium glucoheptonate, and 10 g/L malic acid. The bath has a pH of about 6.0 and is operated at a temperature of about 90° F. No agitation is used. The stripping bath is employed for stripping a relatively thick copper deposit (about 1 mil in thickness) from mild steel at an average current density of about 100 ASF (amperes per square foot). The copper deposit is effectively stripped at a stripping rate of about 0.0001568 inches per minute.

For purposes of comparison, another stripping bath like that specified above is formulated, except with the addition of 8 g/L sodium bromide. The bath has a pH of about 6.0 and is operated at a temperature of about 90° F. No agitation is used. This stripping bath is also employed for stripping a relatively thick copper deposit (about 1 mil) from mild steel at an average current density of about 100 ASF. The copper deposit is only stripped at a rate of about 0.00007 inches per minute, thus indicating the improved stripping rate which results from the elimination of the halogen component in the stripping bath.

EXAMPLE 2

An electrolytic stripping bath suitable for stripping relatively thick copper deposits from mild steel is formulated containing 240 g/L ammonium nitrate, 10 g/L sodium glucoheptonate, and 10 g/L malic acid. The bath has a pH of about 6.0 and is operated at a temperature of about 90° F. No agitation is used. The stripping bath is employed for stripping a relatively thick copper deposit (about 1 mil) from mild steel at an average current density of about 73.3 ASF. The copper deposit is effectively stripped at a stripping rate of about 0.000115 inches per minute.

EXAMPLE 3

An electrolytic stripping bath suitable for stripping relatively thick copper deposits from stainless steel is formulated containing 80 g/L ammonium nitrate, 10 g/L sodium glucoheptonate, 2 g/L ammonium oxalate, and 20 g/L ammonium acetate. The bath has a pH of from about 5.5 to about 6.5 and is operated at a temperature of about 140° F. No agitation is used. The stripping bath is employed for stripping a relatively thick copper deposit (about 1 mil) from type #304 stainless steel at an average current density of about 500 ASF. The copper deposit is effectively stripped at a stripping rate of about 0.001875 inches per minute. The rate of attack on a two square inch coupon is 0.005 grams per 60 minutes.

EXAMPLE 4

An electrolytic stripping bath suitable for stripping relatively thick copper deposits from mild steel is formulated containing 160 g/L ammonium nitrate, 20 g/L sodium glucoheptonate, 2 g/L oxalic acid, and 20 g/L ammonium acetate. The bath has a pH of about 6.3 and is operated at a temperature of about 80° F. Air agitation is used. The stripping bath is employed for stripping a relatively thick copper deposit (about three inches) from mild steel at an average current density of about 100 ASF. The copper deposit is effectively stripped at a stripping rate of about 0.0001287 inches per minute. The rate of attack on a two square inch coupon is 0.000 grams per 30 minutes.

EXAMPLE 5

An electrolytic stripping bath suitable for stripping relatively thick copper deposits from stainless steel is formulated containing 80 g/L ammonium nitrate, 10 g/L sodium glucoheptonate, 2 g/L ammonium oxalate, and 20 g/L acetic acid added as glacial acetic acid. The bath has a pH of from about 5.2 to about 6.2 and is operated at a temperature of about 100° F. No agitation is used. The stripping bath is employed for stripping a relatively thick copper deposit (about 1 mil) from type #304 stainless steel at an average current density of about 90 ASF. The copper deposit is effectively stripped at a stripping rate of about 0.0001875 inches per minute.

EXAMPLE 6

An electrolytic stripping bath suitable for stripping relatively thick chromium deposits from stainless steel is formulated containing 80 g/L ammonium nitrate, 10 g/L sodium glucoheptonate, 2 g/L ammonium oxalate, and 20 g/L acetic added as glacial acetic acid. The bath has a pH of from about 5.2 to about 6.2 and is operated at a temperature of about 100° F. No agitation is used. The stripping bath is employed for stripping a relatively thick chromium deposit (about 1 mil) from type #304 stainless steel at an average current density of about 90 ASF. The chromium deposit is effectively stripped at a stripping rate of about 0.000068 inches per minute.

EXAMPLE 7

An electrolytic stripping bath suitable for stripping relatively thick copper deposits from mild steel is formulated containing 240 g/L ammonium nitrate, 10 g/L sodium glucoheptonate, and 10 g/L sodium gluconate. The bath has a pH of about 5.6 and is operated at a temperature of about 90° F. No agitation is used. The stripping bath is employed for stripping a relatively thick copper deposit (about 1 mil) from mild steel at an average current density of about 100 ASF. The copper deposit is effectively stripped at a stripping rate of about 0.0001052 inches per minute.

EXAMPLE 8

An electrolytic stripping bath suitable for stripping relatively thick copper deposits from mild steel is formulated containing 240 g/L ammonium nitrate, 10 g/L sodium glucoheptonate, and 10 g/L sodium citrate. The bath has a pH of about 6.4 and is operated at a temperature of about 90° F. No agitation is used. The stripping bath is employed for stripping a relatively thick copper deposit (about 1 mil) from mild steel at an average current density of about 100 ASF. The copper deposit is effectively stripped at a stripping rate of about 0.0001146 inches per minute.

EXAMPLE 9

An electrolytic stripping bath suitable for stripping relatively thick copper deposits from mild steel is formulated containing 240 g/L sodium nitrate, 10 g/L sodium glucoheptonate, and 10 g/L potassium tartrate. The bath has a pH of about 6.2 and is operated at a temperature of about 90° F. No agitation is used. The stripping bath is employed for stripping a relatively thick copper deposit (about 1 mil) from mild steel at an average current density of about 100 ASF. The copper deposit is effectively stripped at a stripping rate of about 0.0001022 inches per minute.

EXAMPLE 10

An electrolytic stripping bath suitable for stripping relatively thick copper deposits from mild steel is formulated containing 240 g/L sodium nitrate, 10 g/L sodium glucoheptonate, and 8 g/L fumaric acid. The bath has a pH of about 6.0 and is operated at a temperature of about 90° F. No agitation is used. The stripping bath is employed for stripping a relatively thick copper deposit (about 1 mil) from mild steel at an average current density of about 100 ASF. The copper deposit is effectively stripped at a stripping rate of about 0.0001045 inches per minute.

EXAMPLE 11

An electrolytic stripping bath suitable for stripping relatively thick brass deposits from mild steel is formulated containing 240 g/L ammonium nitrate, 10 g/L sodium glucoheptonate, and 10 g/L malic acid. The bath has a pH of about 5.9 and is operated at a temperature of about 90° F. No agitation is used. The stripping bath is employed for stripping a relatively thick brass deposit (about 1/16 inch) from mild steel at an average current density of about 100 ASF. The brass deposit is effectively stripped at a stripping rate of about 0.00010 inches per minute.

EXAMPLE 12

An electrolytic stripping bath suitable for stripping relatively thick bronze deposits from mild steel is formulated containing 300 g/L ammonium nitrate, 10 g/L sodium glucoheptonate, and 10 g/L malic acid. The bath has a pH of about 5.9 and is operated at a temperature of about 90° F. No agitation is used. The stripping bath is employed for stripping a relatively thick bronze deposit (about ⅛ inch) from mild steel at an average current density of about 100 ASF. The bronze deposit is effectively stripped at a stripping rate of about 0.0001073 inches per minute.

EXAMPLE 13

An electrolytic stripping bath suitable for stripping relatively thick copper deposits from mild steel is formulated containing 15 g/L isopropanolamine, 36 g/L sodium glucoheptonate, and 20 g/L malic acid. The bath has a pH of about 3.8 and is operated at a temperature of about 100° F. Cathode rod agitation is used. The stripping bath is employed for stripping a relatively thick copper deposit (about 1 mil) from mild steel at an average current density of about 90 ASF. The copper deposit is effectively stripped at a stripping rate of about 0.0001027 inches per minute.

EXAMPLE 14

An electrolytic stripping bath suitable for stripping relatively thick copper deposits from mild steel is formulated containing 15 g/L isopropanolamine, 50 g/L sodium nitrate, 36 g/L sodium glucoheptonate, and 36 g/L malic acid. The bath has a pH of about 4.0 and is operated at a temperature of about 90° F. Cathode rod agitation is used. The stripping bath is employed for stripping a relatively thick copper deposit (about 1 mil) from mild steel at an average current density of about 90 ASF. The copper deposit is effectively stripped at a stripping rate of about 0.000106 inches per minute.

EXAMPLE 15

Additional electrolytic stripping baths suitable for stripping relatively thick copper, copper alloy, or chromium deposits from a ferrous basis metal are formulated containing an aqueous solution having a pH of from about 1 to about 14 and consisting essentially of a stripping component selected from the group consisiting of (a) a bath soluble primary, secondary, and/or tertiary amine having a carbon content of $C_1$ to $C_8$, (b) a bath soluble inorganic nitrate and/or organic nitro compound, and mixtures of (a) and (b); and sodium glucoheptonate present in an effective amount to inhibit attack of the basis metal, including amounts of from about 1 g/L to saturation. Still additional baths are prepared which further contain at least one bath soluble compound selected from the group consisting of malic acid, oxalic acid, and mixtures thereof, as well as the Group IA, IIA, and ammonium salts thereof, present in an effective amount, when combined with said sodium glucoheptonate, to inhibit attack of the basis metal, including amounts of from about 1 to about 20 g/L; and/or a carboxylic acid buffering agent including at least one material selected from the group consisting of gluconic acid, lactic acid, tartaric acid, fumaric acid, citric acid, isoascorbic acid, succinic acid, acetic acid, and mixtures thereof, as well as the alkali metal and ammonium salts thereof, present in an amount including up to about 60 g/L. When such stripping baths are employed for stripping relatively thick copper, copper alloy, or chromium deposits from a ferrous basis metal, the metal deposits will be effectively stripped and attack of the basis metal will be inhibited.

Among the advantages of the present invention, in addition to those referred to hereinabove, is that an electrolytic stripping solution is provided for use in the present stripping bath and process which is particularly suited for use in stripping relatively thick copper, copper alloy, or chromium deposits, i.e., greater than about 1 mil up to several inches in thickness, from ferrous basis metals. The stripping rates for relatively thick copper, copper alloy, or chromium deposits are significantly improved over current processes in which stripping baths containing a halogen component are used. By way of further example, stripping rates for relatively thick copper deposits using current halogen containing stripping solutions decrease as the thickness of the copper deposits increase. This is due to the formation of heavy cuprous halide deposits or fouling on the anode during the stripping operation. It has been found that a solution made in accordance with the above teachings can strip relatively thick copper in a fraction of the time required for halogen-containing solutions. The present invention thus provides fast and uniform stripping rates, but yet provides maximum protection to the substrate below. (The rate of attack values given in Examples 3 and 4 above indicate no visible attack on the steel substrates.)

While it will be apparent that the invention herein disclosed is well calculated to achieve the benefits and advantages as hereinabove set forth, it will be appreciated that the invention is susceptible to modification, variation, and change without departing from the spirit thereof.

What is claimed is:

1. An electrolytic stripping bath for stripping copper, copper alloy, or chromium deposits from a ferrous basis metal comprising an aqueous solution having a pH of from about 1 to about 14 and consisting essentially of a stripping component selected from the group consisting of (a) a bath soluble primary, secondary, and/or tertiary amine having a carbon content of $C_1$ to $C_8$, (b) a bath soluble inorganic nitrate and/or organic nitro compound, and mixtures of (a) and (b); and sodium glucoheptonate present in an effective amount to inhibit attack of the basis metal.

2. The stripping bath as defined in claim 1 in which said sodium glucoheptonate is present in an amount of from about 1 g/L to saturation.

3. The stripping bath as defined in claim 1 in which said sodium glucoheptonate is present in an amount of from about 5 to about 50 g/L.

4. The stripping bath as defined in claim 1 in which said solution further contains at least one bath soluble compound selected from the group consisting of malic acid, oxalic acid, and mixtures thereof, as well as the Group IA, IIA, and ammonium salts thereof, present in an effective amount, when combined with said sodium glucoheptonate, to inhibit attack of the basis metal.

5. The stripping bath as defined in claim 4 in which said bath soluble compound is present in an amount of from about 1 to about 20 g/L.

6. The stripping bath as defined in claim 4 in which said bath soluble compound is malic acid which is present in an amount of about 10 g/L, and in which said sodium glucoheptonate is present in an amount of about 10 g/L.

7. The stripping bath as defined in claim 4 in which said solution further contains a carboxylic acid buffering agent.

8. The stripping bath as defined in claim 7 in which said carboxylic acid buffering agent comprises at least one material selected from the group consisting of gluconic acid, lactic acid, tartaric acid, fumaric acid, citric acid, isoascorbic acid, succinic acid, acetic acid, and mixtures thereof, as well as the alkali metal and ammonium salts thereof.

9. The stripping bath as defined in claim 7 in which said buffering agent is present in an amount of up to about 60 g/L.

10. The stripping bath as defined in claim 7 in which said buffering agent is present in an amount of from about 20 to about 40 g/L.

11. The stripping bath as defined in claim 1 in which said solution further contains a carboxylic acid buffering agent.

12. The stripping bath as defined in claim 11 in which said carboxylic acid buffering agent comprises at least one material selected from the group consisting of gluconic acid, lactic acid, tartaric acid, fumaric acid, citric acid, isoascorbic acid, succinic acid, acetic acid, and mixtures thereof, as well as the alkali metal and ammonium salts thereof.

13. The stripping bath as defined in claim 11 in which said buffering agent is present in an amount of up to about 60 g/L.

14. The stripping bath as defined in claim 11 in which said buffering agent is present in an amount of from about 20 to about 40 g/L.

15. The stripping bath as defined in claim 1 having a pH of from about 5.0 to about 7.5.

16. A process for electrolytically stripping copper, copper alloy, or chromium deposits from a ferrous basis metal which comprises the steps of immersing an object to be stripped in a stripping bath comprising an aqueous solution having a pH of from about 1 to about 14 and consisting essentially of a stripping component selected from the group consisting of (a) a bath soluble primary, secondary, and/or tertiary amine having a carbon content of $C_1$ to $C_8$, (b) a bath soluble inorganic nitrate and/or organic nitro compound, and mixtures of (a) and (b); and sodium glucoheptonate present in an effective amount to inhibit attack of the basis metal; anodically charging the object; and passing electric current through the solution to a cathode for a period of time to achieve the desired magnitude of stripping of the metal deposit from the object.

17. The process as defined in claim 16 in which said sodium glucoheptonate is present in an amount of from about 1 g/L to saturation.

18. The process as defined in claim 16 in which said sodium glucoheptonate is present in an amount of from about 5 to about 50 g/L.

19. The process as defined in claim 16 in which said solution further contains at least one bath soluble compound selected from the group consisting of malic acid, oxalic acid, and mixtures thereof, as well as the Group IA, IIA, and ammonium salts thereof, present in an effective amount, when combined with said sodium glucoheptonate, to inhibit attack of the basis metal.

20. The process as defined in claim 19 in which said bath soluble compound is present in an amount of from about 1 to about 20 g/L.

21. The process as defined in claim 19 in which said bath soluble compound is malic acid which is present in an amount of about 10 g/L, and in which said sodium glucoheptonate is present in an amount of about 10 g/L.

22. The process as defined in claim 19 in which said solution further contains a carboxylic acid buffering agent.

23. The process as defined in claim 22 in which said carboxylic acid buffering agent comprises at least one material selected from the group consisting of gluconic acid, lactic acid, tartaric acid, fumaric acid, citric acid, isoascorbic acid, succinic acid, acetic acid, and mixtures thereof, as well as the alkali metal and ammonium salts thereof.

24. The process as defined in claim 22 in which said buffering agent is present in an amount of up to about 60 g/L.

25. The process as defined in claim 22 in which said buffering agent is present in an amount of from about 20 to about 40 g/L.

26. The process as defined in claim 16 in which said solution further contains a carboxylic acid buffering agent.

27. The process as defined in claim 26 in which said carboxylic acid buffering agent comprises at least one material selected from the group consisting of gluconic acid, lactic acid, tartaric acid, fumaric acid, citric acid, isoascorbic acid, succinic acid, acetic acid, and mixtures thereof, as well as the alkali metal and ammonium salts thereof.

28. The process as defined in claim 26 in which said buffering agent is present in an amount of up to about 60 g/L.

29. The process as defined in claim 26 in which said buffering agent is present in an amount of from about 20 to about 40 g/L.

30. The process as defined in claim 16 including the further step of controlling the pH of said bath between about 5.0 to about 7.5.

* * * * *